US009505252B2

(12) United States Patent
Aoi

(10) Patent No.: US 9,505,252 B2
(45) Date of Patent: Nov. 29, 2016

(54) RECORDING APPARATUS

(71) Applicant: Oki Data Infotech Corporation, Chiba (JP)

(72) Inventor: Yoshihisa Aoi, Chiba (JP)

(73) Assignee: OKI Data Infotech Corporation, Chiba (JP)

( * ) Notice: Subject to any disclaimer, the term of this patent is extended or adjusted under 35 U.S.C. 154(b) by 0 days.

(21) Appl. No.: 15/077,140

(22) Filed: Mar. 22, 2016

(65) Prior Publication Data

US 2016/0279992 A1 Sep. 29, 2016

(30) Foreign Application Priority Data

Mar. 25, 2015 (JP) ..... 2015-062834

(51) Int. Cl.
*B41J 29/393* (2006.01)
*B41J 2/165* (2006.01)

(52) U.S. Cl.
CPC ..... *B41J 29/393* (2013.01); *B41J 2/16579* (2013.01)

(58) Field of Classification Search
CPC B41J 2/16579; B41J 11/0095; B41J 29/393; B41J 2029/3935; H04N 1/4078; H04N 1/6033; H04N 1/6055; H04N 1/6064
See application file for complete search history.

(56) References Cited

U.S. PATENT DOCUMENTS 7,101,017 B2 * 9/2006 Endo ..... B41J 29/393 347/19
7,318,637 B2 * 1/2008 Ishimoto ..... B41J 29/393 347/19
7,621,614 B2 * 11/2009 Endo ..... B41J 29/393 347/19
8,506,038 B2 * 8/2013 Mizes ..... B41J 2/2135 347/15
2005/0073547 A1 4/2005 Endo
2006/0033770 A1 2/2006 Yamasaki et al.
2010/0309240 A1 12/2010 Tomida et al.
2012/0050378 A1 3/2012 Kido

FOREIGN PATENT DOCUMENTS

EP 1403085 A2 3/2004
JP H10138513 A 5/1998
WO 2010004946 A1 1/2010
WO 2014178201 A1 11/2014

OTHER PUBLICATIONS

Extended European Search Report issued Aug. 5, 2016 in EP Application No. 16161519.0.

* cited by examiner

*Primary Examiner* — Anh T. N. Vo
(74) *Attorney, Agent, or Firm* — Panitch Schwarze Belisario & Nadel LLP

(57) ABSTRACT

A recording apparatus includes a recording head having nozzles ejecting ink onto a recording medium, a conveying unit that conveys the recording medium, and a carriage. A sensor is mounted on the carriage for detecting image density. A detection controller that performs control to record test patterns on the recording medium and read densities of the test patterns using the sensor to thereby detect a non-ejection nozzle of the recording head. The test patterns are formed by recording a line including a predetermined number of dots in predetermined areas for respective nozzles every plurality of times of conveyance of the recording medium. The detection controller reads the test patterns using the sensor, calculates a position of a non-recorded portion in the test patterns, and specifies a position of the non-ejection nozzle based on the calculated position of the non-recorded portion and positions of the nozzles that record the test patterns.

7 Claims, 6 Drawing Sheets

FIG.5A
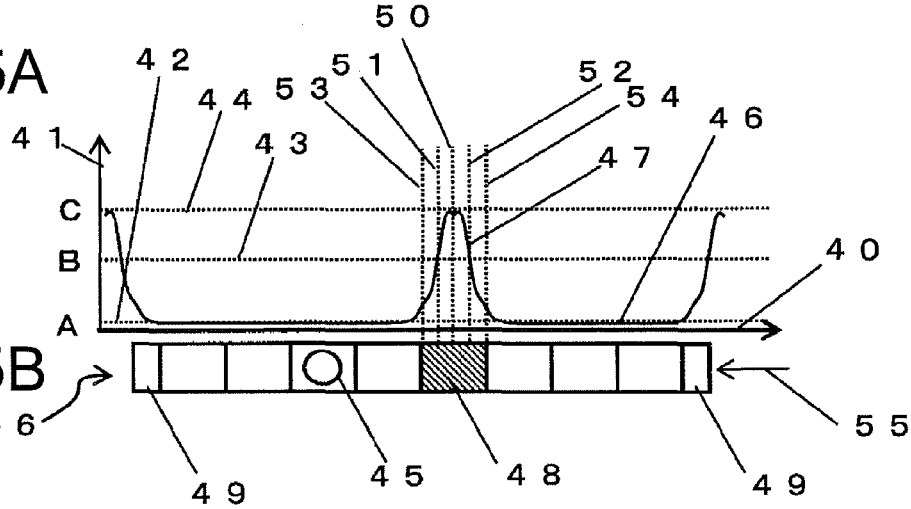
FIG.5B
FIG. 6A
FIG. 6B
FIG. 6C
FIG. 6D
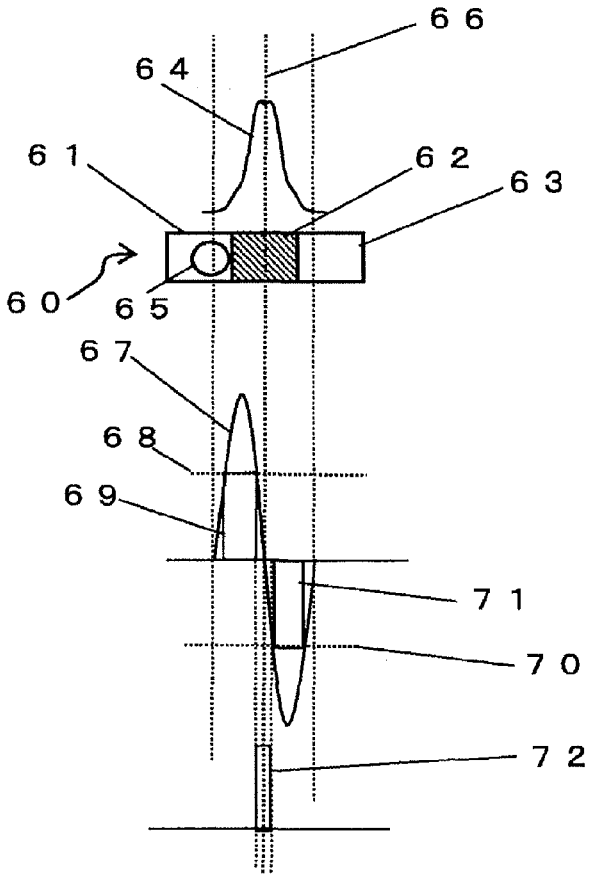

RECORDING APPARATUS

BACKGROUND OF THE INVENTION

The present invention relates to a recording apparatus including an inkjet head that ejects ink to a recording medium.

An inkjet recording apparatus is widely used. The inkjet recording apparatus is configured to supply ink from an ink cartridge to an inkjet recording head, and eject ink droplets from the recording head onto a recording medium to record an image, character or the like.

Such an inkjet recording head is adopted not only a small-sized recording head for use in a home, small office or the like, but also for a large-sized recording head capable of printing onto a large recording medium having a width of 1 m or wider.

The inkjet recording apparatus includes a carriage on which the recording head is mounted. The carriage is configured to reciprocate across the recording medium in a widthwise direction. The recording head ejects ink onto the recording medium on a forward path and on a backward path. A position of the carriage is detected by reading a linear scale provided along a moving direction of the carriage using a sensor mounted on the carriage. Generally, a device referred to as a linear encoder is used.

The recording head has a lot of small holes, i.e., nozzles. There are cases where the nozzle may be clogged with thickened ink, dust or the like. When the nozzle is clogged, ink is not ejected from the clogged nozzle, and therefore a stripe pattern may be formed in a recorded image.

In order to prevent non-ejection from the nozzle Japanese Laid-Open Patent Publication No. 10-138513 discloses processing performed before recording. In the processing, a test pattern is recorded using respective nozzles, the recorded test pattern is read by an optical sensor to thereby determine a non-ejection nozzle, and an ejection signal is sent to the non-ejection nozzle to forcedly eject ink.

However, in the related art, for example, when the nozzles are arranged at a density of 400 dpi, a nozzle pitch is 63 μm, and a line recorded using one dot has a width of approximately 150 to 200 μm. The sensor has a wide detection range which may include both of a recorded portion and a non-recorded portion. Therefore, when light color ink is used, a contrast between the test pattern and the recording medium is low, and therefore the test pattern may not be accurately detected, i.e., misdetection may occur. Further, the test pattern need be determined in consideration of the detection range of the sensor, a conveyance accuracy of the recording medium, and a relative movement accuracy of the recording medium and the sensor. Therefore, it is necessary to widen a line spacing of the test pattern, and therefore a recording area of the test pattern becomes large.

SUMMARY OF THE INVENTION

The present invention is intended to provide a recording apparatus capable of accurately detecting a non-ejection nozzle while reducing an area on a recording medium for detecting the non-ejection nozzle.

According to an aspect of the present invention, there is provided a recording apparatus recording an image on a recording medium. The recording apparatus includes a recording head including a plurality of nozzles ejecting ink onto the recording medium, a conveying unit that conveys the recording medium, and a carriage on which the recording head is mounted. The carriage reciprocates the recording head for scanning in a direction crossing a conveying direction of the recording medium. The recording apparatus further includes a platen provided at a position facing the recording head along a scanning direction of the recording head. The platen supports the recording medium. The recording apparatus further includes a sensor mounted on the carriage and detecting a density of an image recorded on the recording medium, and a detection controller that performs control to record test patterns on the recording medium and read densities of the test patterns using the sensor to thereby detect a non-ejection nozzle of the recording head. The test patterns are formed by recording a line including a predetermined number of dots in predetermined areas for respective nozzles every plurality of times of conveyance of the recording medium. The detection controller reads the test patterns recorded on the recording medium using the sensor, calculates a position of a non-recorded portion in the test patterns, and specifies a position of the non-ejection nozzle based on the calculated position of the non-recorded portion and positions of the nozzles that record the test patterns.

With such a configuration, it becomes possible to provide a recording apparatus capable accurately detecting non-ejection nozzle while reducing an area of a recording medium used for detection of non-ejection nozzle.

BRIEF DESCRIPTION OF THE DRAWINGS

In the attached drawings:

FIGS. 5A and 5B are schematic views for illustrating an example of a detecting operation of the test pattern;

FIGS. 6A, 6B, 6C and 6D are schematic views illustrating another example of the detecting operation of the test pattern.

DETAILED DESCRIPTION OF THE PREFERRED EMBODIMENT

Hereinafter, the embodiment of the present invention will be described with reference to the drawings.

Figure 7:
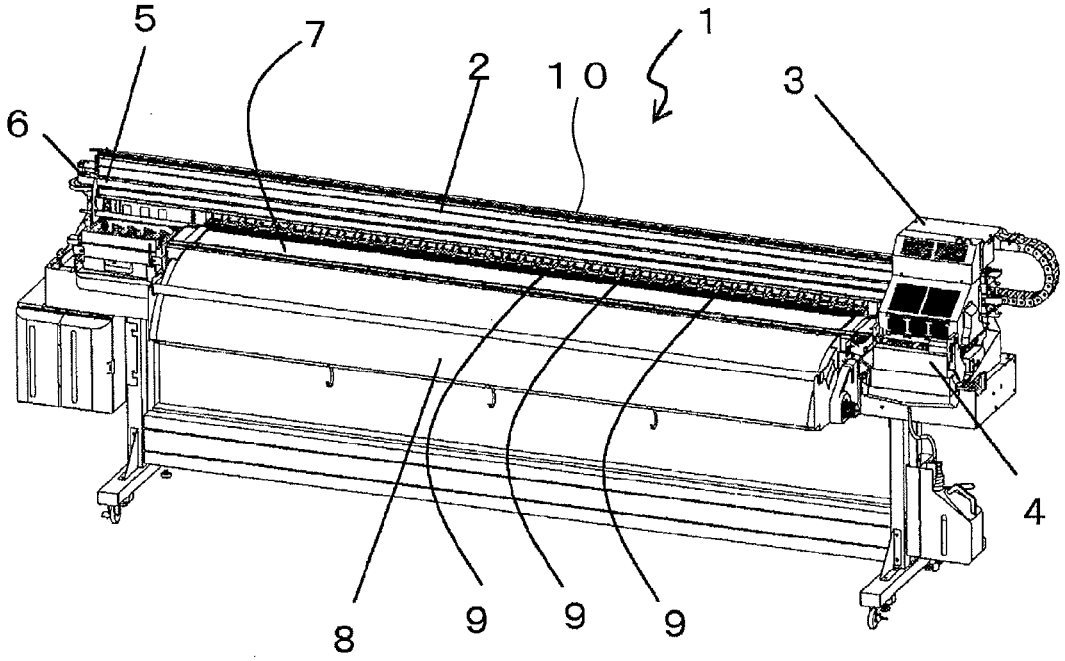
FIG. 7 is a schematic view showing an entire configuration of a recording apparatus.

First, an entire configuration of an inkjet printer 1 as a recording apparatus of this embodiment will be described with reference to FIG. 7. FIG. 7 is a schematic view showing an entire configuration of a recording apparatus. The inkjet printer 1 includes a rail 2 linearly extending in a width direction. A carriage 3 is movable reciprocally along the rail 2. Inkjet recording heads are mounted on the carriage 3. In order to perform color printing, six recording heads using ink of six colors of ink, i.e., yellow ink, cyan ink, magenta ink, black ink, light cyan ink, light magenta ink are mounted to the carriage 3. The light cyan ink has a lower pigment concentration than the cyan ink. The light magenta ink has a lower pigment concentration than the magenta ink. By using the light ink, color reproducibility is enhanced, and quality of recorded image can be enhanced. A cap 4 hermetically seals the recording heads to prevent the recording heads from being dried, and periodically sucks ink from the recording heads for maintenance. A conveying unit is configured to convey a recording medium such as a paper, a plastic film or the like, and includes a plurality of conveying rollers 9 arranged along the rail 2. By rotating the conveying rollers 9, the recording medium is conveyed.

The carriage 3 is connected to an endless belt 5. The endless belt 5 is connected to a motor 6. The endless belt 5 is wound around a pulley provided at an end of the inkjet printer 1. By driving the motor 6, the endless belt 5 moves, and the carriage 3 moves together with the endless belt 5.

A linear scale 10 is provided along the rail 2. A linear encoder is mounted on the carriage 3. The linear encoder reads scales of the linear scale 10 to thereby acquire a position of the carriage 3.

The platen 7 is a flat plate provided along the rail 2. The platen 7 has a plurality of suction holes on a surface thereof. The platen 7 holds the conveyed recording medium by suctioning the recording medium through the suction holes. A downstream guide 8 is provided downstream of the platen 7 in a conveying direction of the recording medium. The downstream guide 8 guides the conveyed recording medium. Further, an upstream guide is provided upstream of the platen 7 in the conveying direction of the recording medium. Each of the platen 7, the downstream guide 8 and the upstream guide is provided with a heater, and is heated thereby. The heating of the platen 7, the downstream guide 8 and the upstream guide causes the conveyed recording medium to be heated to an appropriate temperature, and promotes fixing of the ink.

The platen 7 is a flat plate made of aluminum. The flat plate made of aluminum has a flat surface, and the suction holes are formed on the flat surface. A groove is formed on a backside of the flat plate, and a heater wire is embedded in the groove for heating the platen 7. Each of the downstream guide 8 and the upstream guide is formed by bending a plate made of iron, and a heater wire is provided on a backside of the plate. The heater wire is covered with and fixed by an aluminum sheet.

Figure 1:
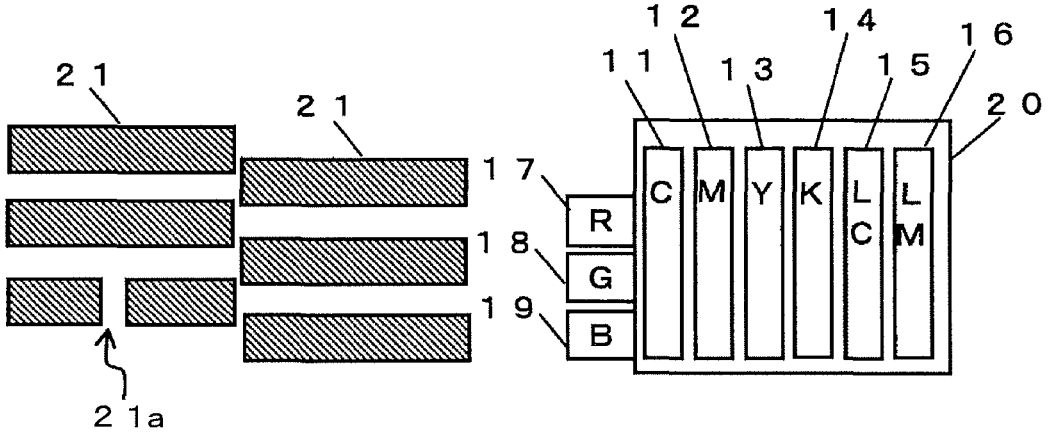
FIG. 1 is a schematic view of a layout of recording heads and test patterns.

FIG. 1 is a schematic view showing a layout of the recording heads and the test patterns. The carriage 3 includes a carriage base 20 provided at a position facing the platen 7, and the recording heads are fixed to the carriage base 20. The six recording heads 11 through 16 respectively corresponding to cyan, magenta, yellow, black, light cyan and light magenta are fixed to the carriage base 20 in such a manner that nozzle surfaces face the platen 7. That is, the cyan recording head 11, the magenta recording head 12, the yellow recording head 13, the black recording head 14, the light cyan recording head 15 and the light magenta recording head 16 are fixed to the carriage base 20. An R detection unit 17 is used to detect cyan and light cyan. The cyan ink and light cyan ink contain the same pigment at different concentrations, and therefore can be detected using the same detection unit. A G detection unit 18 is used to detect magenta and light magenta for the similar reason. A B detection unit 19 is used to detect yellow. The B detection unit 19 is also used to detect black, since the B detection unit 19 is more responsive to black than other detection units (i.e., other light sources).

The test patterns 21 for detection are recorded on the recording medium. A non-ejection portion 21*a* is a portion where no image is recorded because of non-ejection of ink for some reason. A nozzle that is to eject ink onto to the non-ejection portion 21*a* is determined, and is replaced with another nozzle. This suppresses negative influence on quality of a recorded image. The test patterns 21 are configured so that different recording areas are assigned to respective nozzles, and therefore recording positions of the respective nozzles can be specified. That is, based on the test pattern recorded on the recording medium, the nozzle used to record can be specified.

Figure 2A:
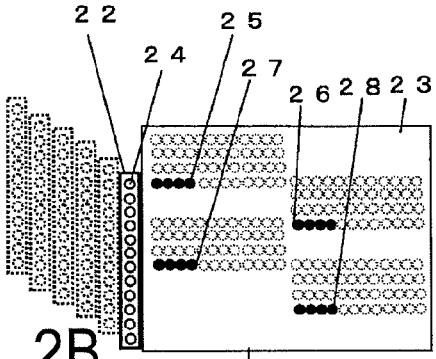
FIGS. 2A through 2F are schematic views for illustrating a recording method of the test patterns.

FIGS. 2A through 2F are views for illustrating a recording method of the test patterns. The test patterns will be described with reference to FIGS. 2A through 2F. In order to facilitate explanation, description will be given of an example where the recording head 22 has 12 nozzles. From the first nozzle 24 on an end of the recording head 22 to the nozzle on the other end of the recording head 22, the 12 nozzles are referred to as the first nozzle 24, the second nozzle, the third nozzle . . . and the twelves nozzle. First, the recording medium 23 is conveyed to an initial position as shown in FIG. 2A. By moving the carriage 3, the first nozzle 24 records a first line 25, the fourth nozzle records a second line 26, the seventh nozzle records a third line 27, and the tenth nozzle records a fourth line 28. Each of these lines has a length corresponding to a predetermined number of dots, in this example, 4 dots. Then, the recording medium 23 is conveyed by one line. Broken lines (in the form of the recording heads) indicate respective positions of the recording head when the recording head is conveyed by one line. Broken lines (in the form of circles) indicate positions of dots of the test patterns which are not yet recorded.

Figure 2B:
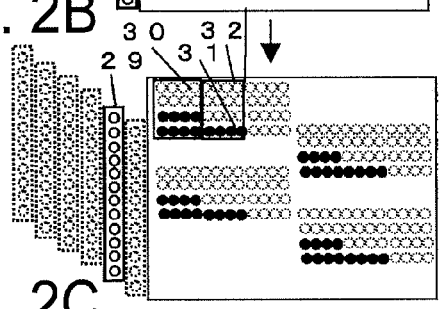

Then, the recording medium 23 is conveyed, and a position on which recording is to be performed moves by one line as shown in FIG. 2B. In this state, the recording head is in a position indicated by numeral 29 relative to the recording medium 23. A position of the second nozzle in a scanning direction is in a position where the first line 25 is recorded. In this state, lines are recorded using the first nozzle 24, the second nozzle, the fourth nozzle, the fifth nozzle, the seventh nozzle, the eighth nozzle, the tenth nozzle and the eleventh nozzle. For example, the first nozzle 24 records a line of 4 dots in a first nozzle area 30. The respective nozzles record lines in recording areas assigned to the respective nozzles. The second nozzle records a fifth line 31 in the second nozzle area 32. In this way, using the same nozzle, lines each including a predetermined number of dots (in this example, four dots) in the scanning direction are recorded in an area of a predetermined number of lines (in this example, four lines) in the conveying direction. By setting the recording area to be larger than a detection range of a detection unit, misdetection can be prevented.

Figure 2C:
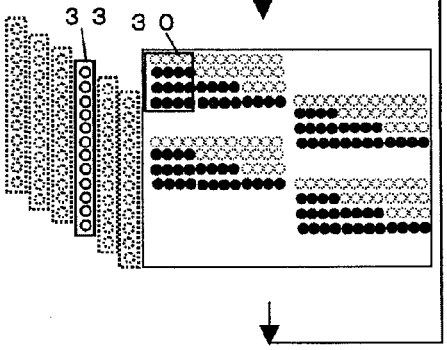

Then, the recording medium 23 is conveyed by one line as shown in FIG. 2C. In this state, the recording head is in a position indicated by numeral 33 relative to the recording medium 23. Using the first nozzle 24 through the twelves nozzle, lines are recorded in recording areas assigned to the respective nozzles. For example, the first nozzle 24 records a third line in the first nozzle area 30.

Figure 2D:
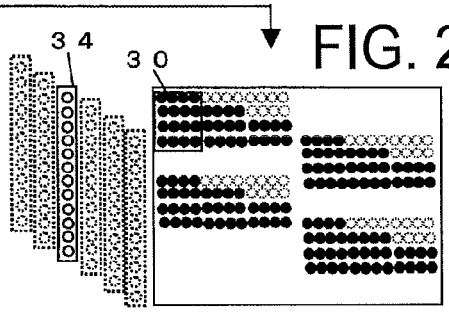

Then, the recording medium 23 is conveyed by one line as shown in FIG. 2D. In this state, the recording head is in a position indicated by numeral 34 relative to the recording medium 23. Using the first nozzle 24 through the twelves nozzle, lines are recorded in recording areas assigned to the respective nozzles. For example, the first nozzle 24 records a fourth line in the first nozzle area 30. The first nozzle 24, the fourth nozzle, the seventh nozzle, and the tenth nozzle complete recording on the respective recording areas.

Figure 2E:
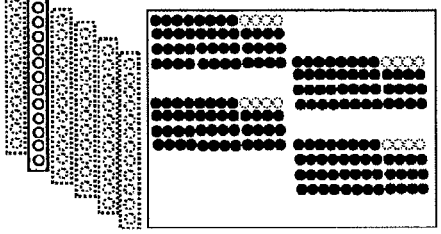

Then, the recording medium 23 is conveyed by one line as shown in FIG. 2E. In this state, the recording head is in a position indicated by numeral 35 relative to the recording medium 23. Using the nozzles that do not complete recording, lines are recorded. The second nozzle, the fifth nozzle, the eighth nozzle, and the eleventh nozzle complete recording on the respective recording areas.

Figure 2F:
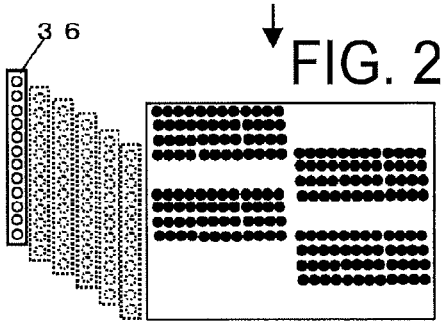

Then, the recording medium 23 is conveyed by one line as shown in FIG. 2F. In this state, the recording head is in a position indicated by numeral 36 relative to the recording medium 23. Using the nozzles that do not complete recording, lines are recorded in recording areas. The third nozzle, the sixth nozzle, the ninth nozzle, and the twelfth nozzle complete recording on the respective recording areas.

In this example, lines are recorded so as to obtain the maximum recording resolution in the conveying direction of the recording medium 23. However, the present invention is not limited to this example. For example, it is also possible to perform recording while conveying the recording medium 23 to provide a one line interval (i.e., to leave one blank line between lines). In this case, an amount of ink of the recorded dots per unit area on the recording medium decreases. Therefore, in order to prevent a decrease in detection accuracy, it is conceivable to perform recording on a forward path and a backward path to thereby increase an amount of ejected ink and to thicken the color of the line. Further, it is also conceivable to convey the recording medium while repeatedly changing the line interval in the conveying direction in the order of 0 line, 1 line, 2 line and 1 line. In this case, when the line interval (i.e., the number of blank lines) is 1 line, it is conceivable to record the same line twice. When the line interval is 2 line, it is conceivable to record the same line thrice. Recording is performed so that an amount of ink of the recorded dots per unit area of the recording medium does not decrease. Further, by using a plurality of conveyance amounts in the conveying direction, recording can be performed even in a case where an erroneous conveyance is likely to occur. The reason is as follows. The recording medium has characteristics such as slipperiness, deformability or the like depending on a type of the recording medium, and there may be cases where the conveying rollers cannot accurately convey the recording medium if the conveyance amount is small. For example, if the conveyance amount corresponds to one line, there may be cases where the recording medium is deformed but not conveyed by the rotation of the conveying rollers. By conveying such a recording medium using a plurality of conveyance amounts, recording can be performed on the recording medium without causing a problem.

Figure 3:
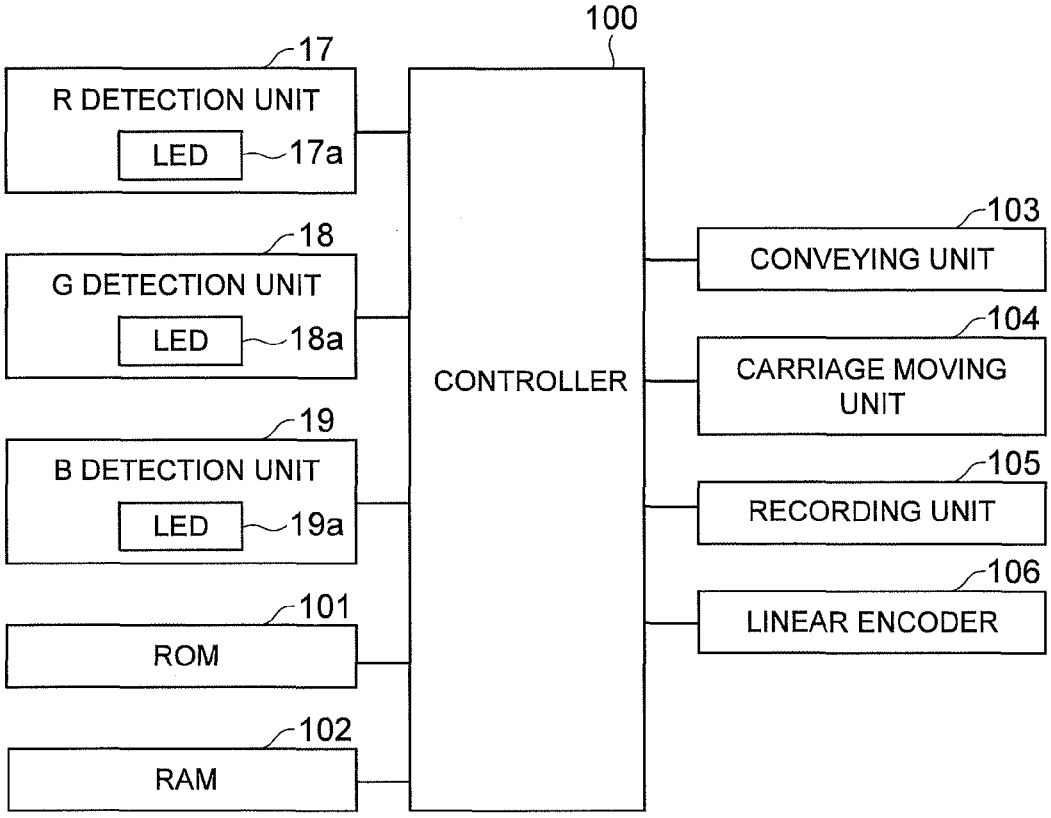
FIG. 3 is a block diagram of a recording apparatus.

FIG. 3 is a block diagram of the recording apparatus. A controller 100 (i.e., a detection controller) is configured to operate in accordance with a program stored in advance and perform various kinds of control of the entire recording apparatus. A ROM 101 is a nonvolatile memory, and stores information such as a program and initial set values for the controller 100. A RAM 102 functions as a working memory used for calculation by the controller 100, and a memory that temporarily stores information.

The conveying unit 103 includes the conveying rollers 9, a motor for driving the conveying rollers 9 and a drive circuit for driving the motor, and is configured to convey the recording medium. The conveying rollers 9 include a pair of a drive roller and a pinch roller, and the drive roller is rotated by the motor. The pinch roller is pressed against the drive roller, and rotates following a rotation of the drive roller. The recording medium is nipped between the drive roller and the pinch roller to be conveyed. A drive circuit of the conveying unit 103 is controlled by the controller 100, and drives the motor to rotate the conveying rollers 9 to thereby convey the recording medium.

A carriage moving unit 104 moves the carriage 3 fixed to the endless belt 5 along the rail 2. The motor 6 for rotating the endless belt 5 is driven by a drive circuit provided in the carriage moving unit 104. The drive circuit is controlled by the controller 100, and drives the motor 6 to move the carriage 3 along the rail 2 in accordance with a program of the controller 100.

A recording unit 105 includes the recording heads corresponding to ink colors. The recording heads eject ink based on a drive signal from a head drive circuit. The head drive circuit operates based on a control signal from the controller 100.

A linear encoder 106 optically detects scales of a linear scale linearly provided along a moving direction of the carriage 3. The linear encoder 106 operates based on a control signal from the controller 100, performs analog-to-digital conversion on a result of the detection, and outputs a signal obtained by conversion to the controller 100. By counting the signal, the controller 100 can specify a position of the carriage 3. That is, the controller 100 can obtain the position of the carriage 3, and perform control in accordance with the position of the carriage 3.

Positions of the respective recording heads mounted on the carriage 3 are specified in advance, and are stored in the ROM 101. A desired image can be recorded by driving the recording heads to eject ink in accordance with the position of the carriage 3, that is, the positions of the recording heads.

Test patterns are stored in advance in the ROM 101. There are a plurality of test patterns in accordance with circumstances. The controller 100 reads necessary test patterns from the plurality of test patterns in accordance with the circumstances, and uses the read test patterns.

The R detection unit 17 includes a red LED (Light Emitting Diode) 17*a* (i.e., a light source) that emits red light, and an optical sensor (i.e., a sensor) that detects reflected light from the lines of cyan and light cyan. The G detection unit 18 includes a green LED 18*a* (i.e., a light source) that emits green light, and an optical sensor (i.e., a sensor) that detects reflected light from the lines of magenta and light magenta. The B detection unit 19 includes a blue LED 19*a* (i.e., a light source) that emits blue light, and an optical sensor (i.e., a sensor) that detects reflected light form the lines of black and yellow. Those detection units 17, 18 and 19 are collectively referred to as a detection unit. Those detection units 17, 18 and 19 detect densities of an image recorded on the recording medium in detection ranges of the respective detection units, and output results of the detection to the controller 100. The controller 100 performs calculations based on the results of detection, and changes ejection timing of the recording heads to enhance quality of an image to be recorded.

Figure 4:
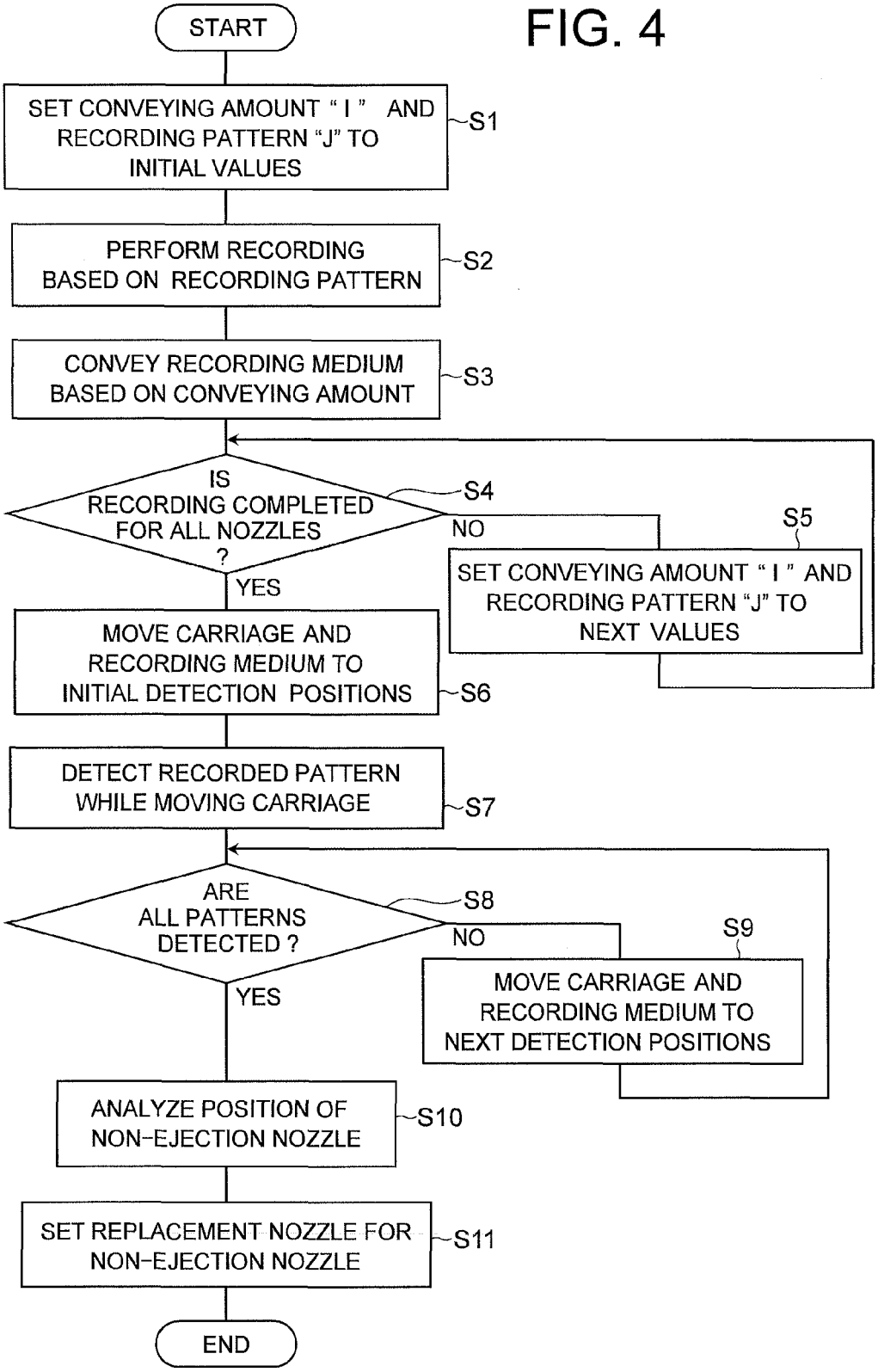
FIG. 4 is a flowchart for illustrating a detecting operation of a non-ejection nozzle.

FIG. 4 is a flowchart for illustrating a detecting operation of the non-ejection nozzle. First, an initialization is performed in step S1. That is, a conveyance amount I and a recording pattern J when the test patterns are to be recorded are determined. For example, the conveyance amount I is set so as to leave one line interval between lines, and the recording pattern J is set so as to record the same line twice. It is also possible to determine the conveyance amount I and the recording pattern J for each recording medium. In the case of a recording medium which is hard to convey, the recording medium may be conveyed while changing the line interval in the order of 0 line, 1 line, 2 line and 1 line. It is preferable to convey the recording medium with a large line interval and a small line interval, and to record lines while adjusting an ejection amount of ink in accordance with the conveyance amount. Further, since light magenta, light cyan, yellow and the like are light colors, it is preferable to eject ink by an amount twice as large as ink of other colors. For example, in order to ensure that the ejection amount of ink of the light colors is double the ejection amount of ink of other colors, it is preferable to eject the ink of the light colors on the forward path and on the backward path.

In step S2, recording is performed based on the recording pattern J. In step S3, the recording medium is conveyed based on the conveyance amount I.

In step S4, it is determined whether recording of the test patterns for all the nozzles is completed. If the recording of the test patterns for all the nozzles is completed, the controller 100 proceeds to step S6. If the recording of the test patterns for all the nozzles is not yet completed, the controller 100 proceeds to step S5.

In step S5, in the case where the conveyance amount I and the recording pattern J are not to be changed, the conveyance amount I and the recording pattern J are kept unchanged. In the case where the conveyance amount I and the recording pattern J are to be changed so as to change the line interval based on the recording medium, the conveyance amount I and the recording pattern J are set according to a predetermined sequence. Then, the controller 100 proceeds to step S2.

In step S6, the carriage 3 and the recording medium 23 are moved to a detection position where detection is performed by the detection units. For example, the carriage 3 and the recording medium 23 are moved to a position where the recording area of the first nozzle in the test patterns is detected by the detection units.

In step S7, the test patterns recorded on the recording medium 23 are detected by the detection units for the colors of the test patterns while the carriage 3 is moved. Detection results (i.e., detection values) is stored in the RAM 102 in association with the positions of the carriage 3.

In step S8, the carriage 3 and the recording medium 23 are moved, and it is determined whether all the test patterns are detected. If all the test patterns are detected, the controller 100 proceeds to step S10. If all the test patterns are yet detected, the controller 100 proceeds to step S9.

In step S9, since the detection of all the test patterns is not yet completed, the carriage 3 and the recording medium 23 are moved to a position where a non-detected pattern is to be detected.

In step S10, a position of the non-ejection nozzle is calculated based on the detection values stored in the RAM 102 in association with the positions of the carriage 3.

Next, in step S11, a normal nozzle (i.e., a replacement nozzle) replacing the non-ejection nozzle is set. For example, a nozzle adjacent to the non-ejection nozzle is set as the replacement nozzle, and is stored in the RAM 102. Alternatively, in the case where lines are recorded using a plurality of paths, another nozzle recording the same line as the non-ejection nozzle is set as the replacement nozzle, and is stored in the RAM 102. Upon recording an image, the controller 100 performs control to cause the replacement nozzle to eject ink.

Further, after the test patterns are recorded by all the nozzles in step S7, it is preferable to record nozzle numbers at portions upstream or downstream of the test patterns recorded by the respective nozzles in the conveying direction of the recording medium. This facilitates checking by a user.

FIG. 5A is a view for illustrating a detection operation of the test patterns. A horizontal axis 40 indicates a position of the carriage 3. A vertical axis 41 indicates a detection result of the detection units. A dotted line 44 corresponding to a value "C" indicates a detection value of a surface of the recording medium 23. A dotted line 43 corresponding to a value "B" indicates a threshold based on which the detection result is determined. A dotted line 42 corresponding to a value "A" indicates a maximum detection value, i.e., a detection value of a portion where the test pattern is recorded.

FIG. 5B is a view for illustrating the test patterns. The test patterns 56 include recording areas of eight nozzles between both end patterns 49. A detection range 45 of the detection unit falls within each of the recording areas. The detection unit performs detection while the detection unit (i.e., the carriage 3) moves in a direction shown by an arrow 55. Each of the end patterns 49 is formed of lines recorded by all the eight nozzles. The detection is performed while the detection range 45 moves. The end patterns 49 are recorded following the test pattern for the endmost nozzle. There is low possibility that none of the eight nozzles ejects ink. Therefore, when recording is performed using all of the eight nozzles, there is almost no possibility that the surface of the recording medium remains exposed. It is preferable to record the end patterns 49 in this way in order to enhance detection accuracy of the test pattern for the endmost nozzle. If there is no end pattern 49, the detection range 45 of the detection unit may contain an outside area of the test pattern as the detection unit moves. If the detection range 45 of the detection unit contains the outside area of the test pattern, the detection value may include a detection value of the surface of the recording medium, and therefore it becomes difficult to compare the detection value of the test pattern with other detection results. For this reason, the end patterns 49 are recorded in order to ensure that the outside area of the test pattern is recorded.

In FIG. 5B, a non-ejection nozzle position 48 indicates a position of the nozzle through which ink is not ejected. Portions other than the non-ejection nozzle position 48 are recorded. The end patterns 49 exhibit the detection value changing from the detection value C to the detection value A. Portions of the normal nozzles exhibit the detection value A. A center 50 of a range of the non-ejection nozzle position 48 exhibits the detection value C. Between a recorded portion and a non-recorded portion, the detection value gradually changes with change in position of the detection range 45. At an end 53 and the other end 54 of the non-ejection nozzle position 48, the detection values are relatively low, since the detection ranges include recorded portions. It is necessary to determine whether the nozzle is the non-ejection nozzle or not based on the detection value of a range including the center 50 and also including the whole detection range 45. Therefore, a median value between the initial detection value C of the surface of the recording medium and the detection value A can be used as the threshold B of the dotted line 43. A portion detected when the carriage 3 is in a position where the detection range 45 includes an end 51 and the other end 52 of a curve cut by the threshold B and includes the center 50 is determined to be the non-ejection nozzle.

Further, in FIG. 5A, the line 46 indicating the detection results is illustrated as a continuous line connecting the detection values at the respective detection positions. Practically, the detection values at the respective detection positions are recorded in the RAM 102. These detection values are treated as a continuous line by connected the detection values. Further, it is also possible to use an average value of previous and next detection values, in order to suppress influence of noise upon detection. Further, although the detection results are determined using the threshold, the detection results may be determined using other method. Under low noise condition, the center of the detection range may be determined based on a peak portion only. However, this is unsuitable in the case where there is noise.

Further, detection noise can be suitably removed by recording a plurality of rows of the test patterns 21, calculating an average value of one row of the test patterns 21, using the average value as a base value, and setting a median value between the initial value and the base value as the threshold.

FIGS. 6A, 6B, 6C and 6D are views for illustrating another example of the detection operation of the test patterns. As well as the method performing determination based on the detection values using the threshold, a method performing determination by analyzing a waveform is also effective. That is, when the detection values are differentiated, a magnitude of change in the detection values can be recognized. Using a differentiation waveform, it becomes possible to more accurately determine where the peak of the detection value is. This method is effective in the case where a portion around the peak is flat, or where there are two peaks. Description will be given of an example of the test patterns 60 for three nozzles. FIG. 6A shows detection values 64 of the test patterns 60. FIG. 6B shows the test patterns 60 including test patterns 61 and 63 for the ejection nozzle and a test pattern 62 for the non-ejection nozzle. A peak portion including a center 66 of the detection position is flat. A detection range 65 indicates an area detected by the optical sensor of the detection unit. Detection is performed while the detection range 65 moves in the scanning direction.

FIG. 6C illustrates a differentiation waveform 67 of the detection values 64. The differentiation waveform 67 changes according to a slope (i.e., inclination) of the detection values 64. A positive threshold value 68 is a threshold value in a state where the slope is positive. A negative threshold value 70 is a threshold value in the state where the slope is negative. Since the slope is reversed, a range of a certain area before and after reversing indicates a center of the test pattern recorded by the non-ejection nozzle. That is, the center 66 is located somewhere in the area 72 shown in FIG. 6D. However, this method is effective when the nozzles of the both sides of the non-ejection nozzle normally eject ink. For example, in the case where the area 72 ranges over two nozzles, there is a less inclined portion between the positive slope and the negative slope corresponding to, for example, two nozzles. In such a case, the non-ejection nozzle is specified based on data ranging over positions for two nozzles. In either case where the area 72 corresponds to one position of the nozzle or two positions of the nozzles, the nozzle(s) corresponding to the area 72 is determined to be the non-ejection nozzle(s).

Comparison between the detection values of the test patterns and the initial detection value of the surface of the recording medium, and calculation to determine the non-ejection nozzle based on the position of the carriage 3 upon detection is detected are performed in a similar manner as described above.

While the preferred embodiments of the present invention have been illustrated in detail, it should be apparent that modifications and improvements may be made to the invention without departing from the spirit and scope of the invention as described in the following claims.

What is claimed is:

1. A recording apparatus recording an image on a recording medium, the recording apparatus comprising:

a recording head including a plurality of nozzles ejecting ink onto the recording medium;

a conveying unit that conveys the recording medium;

a carriage on which the recording head is mounted, the carriage reciprocating the recording head for scanning in a direction crossing a conveying direction of the recording medium;

a platen provided at a position facing the recording head along a scanning direction of the recording head, the platen supporting the recording medium;

a sensor mounted on the carriage and detecting a density of an image recorded on the recording medium; and a detection controller that performs control to record test patterns on the recording medium and read densities of the test patterns using the sensor to thereby detect a non-ejection nozzle of the recording head, wherein the test patterns are formed by recording a line including a predetermined number of dots in predetermined areas for respective nozzles every plurality of times of conveyance of the recording medium; and wherein the detection controller reads the test patterns recorded on the recording medium using the sensor, calculates a position of a non-recorded portion in the test patterns, and specifies a position of the non-ejection nozzle based on the calculated position of the non-recorded portion and positions of the nozzles that record the test patterns.

2. The recording apparatus according to claim 1, wherein the recording head includes a plurality of regions, wherein the nozzle located in the region records test patterns on a plurality of number of lines arranged in the conveying direction of the recording medium.

3. The recording apparatus according to claim 2, wherein the test patterns recorded by the nozzle located in the region include end patterns provided on both ends of the test patterns, and the end patterns are recorded by all of the nozzles located in the region.

4. The recording apparatus according to claim 1, wherein the test patterns are recorded for respective colors of ink, and the sensor is provided for each of the plurality of colors; and wherein the recording apparatus further comprises:

a blue LED used for the test patterns of black ink and yellow ink;

a red LED used for the test patterns of at least cyan ink; and a green LED used for the test patterns of at least magenta ink.

5. The recording apparatus according to claim 1, wherein a conveyance amount of the recording medium when the test patterns are to be recorded on the recording medium is chosen among a plurality of conveyance amounts every scanning of the test patterns.

6. The recording apparatus according to claim 1, wherein the non-ejection nozzle specified by the detection controller is replaced with another nozzle, and an image is recorded on the recording medium using the another nozzle.

7. The recording apparatus according to claim 1, wherein the line of the test patterns is recorded in the same position when the carriage moves along a forward path and when the carriage moves along a backward path.

* * * * *